United States Patent [19]

Woodard

[11] 4,305,054

[45] Dec. 8, 1981

[54] ELECTRIC SWITCH WITH KICK-OFF ATTACHMENT

[75] Inventor: Tony O. Woodard, Pine Level, N.C.

[73] Assignee: Eaton Corporation, Cleveland, Ohio

[21] Appl. No.: 15,351

[22] Filed: Feb. 26, 1979

[51] Int. Cl.[3] ..... H01H 9/20

[52] U.S. Cl. ..... 335/164; 335/168; 200/314

[58] Field of Search ..... 335/164, 166–168, 335/171, 27; 200/314, 315

[56] References Cited

U.S. PATENT DOCUMENTS

| | | | |
|---|---|---|---|
| 3,307,122 | 2/1967 | Ellenberger | 335/164 X |
| 3,925,742 | 12/1975 | Muench | 335/164 X |
| 4,017,700 | 4/1977 | West | 200/314 |
| 4,115,673 | 9/1978 | Smith | 200/315 |

*Primary Examiner*—George Harris

*Attorney, Agent, or Firm*—Hugh R. Rather; William A. Autio

[57] ABSTRACT

An auxiliary add-on attachment is disclosed for use in combination with an existing rocker switch. The attachment includes a spring loaded latch mechanism which upon release drives the rocker button to an OFF position. The latch mechanism is released upon retraction of a solenoid plunger when the solenoid is energized by a trip signal which may, for example, be delivered from a timing circuit when a designated machine should be automatically turned off after a certain length of time, such as cathode ray tubes, computers, photocopy machines, etc. Depressing the rocker button back to its ON position loads and resets the latch mechanism.

9 Claims, 4 Drawing Figures

ELECTRIC SWITCH WITH KICK-OFF ATTACHMENT

BACKGROUND OF THE INVENTION

The present invention evolved from efforts to provide a low cost control affording automatic shut-off of a machine after a specifid delay period. Examples of such machines are cathode ray tubes, computers and photocopiers, though the invention is of course not limited to such applications.

The invention more specifically evolved from efforts to provide an add-on device for use in combination with an elastic switch, with little or no modification of the latter, to engage the switch operator and drive it to an alternate position in response to a trip signal.

SUMMARY OF THE INVENTION

An object of the invention is to provide, in combination with an electric switch, an attachment having a latch mechanism which may be released to drive the switch operator to a designated position, and which may be reset by manually returning the operator to an original position.

Another object is to provide a combination of an electric switch and attachment of the aforenoted character wherein the latch mechanism is released in response to a trip signal, and wherein said latch mechanism may be manually overriden, notwithstanding the presence of a trip signal, by user engagement of the switch operator.

Another object is to provide a combination of an electric switch and attachment of the aforenoted character wherein said latch mechanism when in its loaded position does not interfere with normal operation of said switch operator.

Another object is to provide an attachment of the aforementioned character which may be used in combination with an existing electric switch without alteration of the latter.

Other objects and advantages will hereinafter appear.

DESCRIPTION OF THE PREFERRED EMBODIMENT

Figure 1:
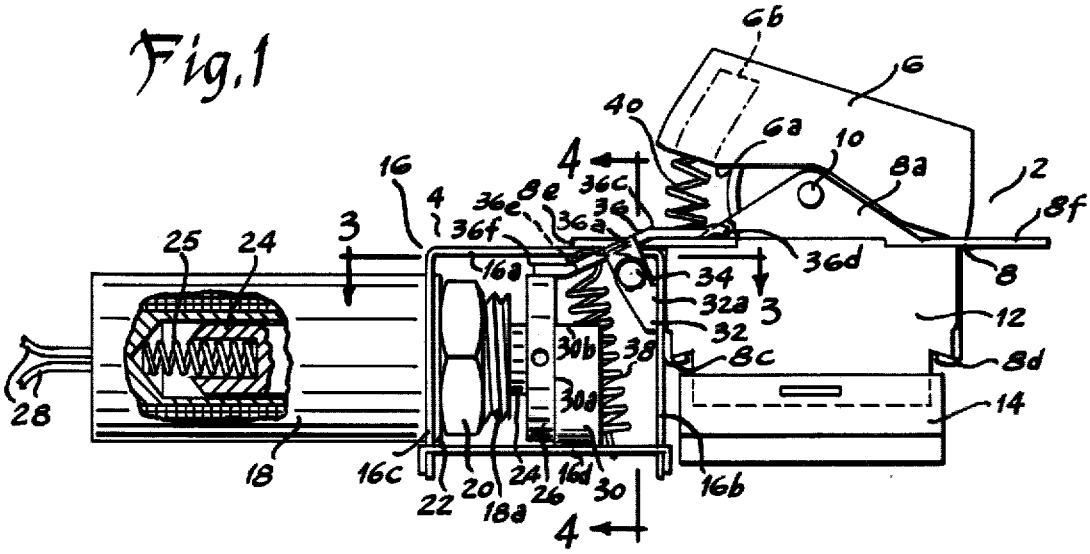
FIG. 1 is a side elevation view of the preferred embodiment of the present invention.

There is shown in FIG. 1 an electric switch 2 with a kick-off attachment 4 constructed in accordance with the invention.

Electric switch 2 has a rocker button operator 6 mounted to upper housing section 8 for pivotal movement about pin 10. The rocker button extends inwardly of lower housing section 12 to operate a set of teeter-totter contacts. Further reference may be had to U.S. Pat. No. 4,115,673 (Smith) which shows a comparable rocker button switch. A protective terminal cover 14 is mounted on the bottom of the housing.

Upper housing section 8 is a metal shroud-like member which covers the open-topped insulating lower housing section 12. Section 8 has an opening in the top thereof through which the lower portion of the rocker button extends, and front and rear upstanding inverted V-shaped supports **8*a* and 8*b* between which extends pin 10. Section 8 has downwardly extending legs 8*c* and 8*d* turned inwardly at their lower ends into notches in the lower housing section for mounting on the latter. Section 8 has leftwardly and rightwardly extending arm sections 8*e* and 8*f***.

The kick-off attachment 4 has a rectangular sheet metal frame 16 which supports the remaining components of the attachment and is mounted to the switch housing by any suitable means, for example, spot welding. As shown in FIG. 1, top frame side **16*a* abuts the underside of left arm 8*e* and right frame side 16*b* abuts left legs 8*c***.

Figure 3:
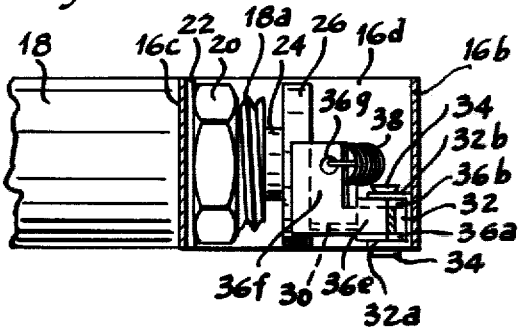
FIG. 3 is a cross-sectional view taken along line 3—3 of FIG. 1.

Mounted through an aperture in left frame side **16*c* is a solenoid 18 secured by nut 20 and washer 22 on threaded solenoid section 18*a* tightened against the frame wall. The solenoid has a plunger 24 biased rightwardly outward by a coil spring 25 within the solenoid housing. The plunger has a circular disk 26 mounted on the end thereof. The solenoid may be energized by a trip signal applied to connection wires 28, which causes leftward movement of the plunger and disk to a retracted position, compressing spring 25. FIGS. 1 and 3 show the solenoid in a nonenergized condition with the plunger and disk rightwardly extended by spring 25 and stopped against the left edge 30*a* of an upstanding tang member 30 which is mounted to bottom frame side 16*d***.

Mounted to right frame side **16*b* near the top front edge thereof is a pin supporting member 32, FIGS. 1 and 3, having a pair of front and rear spaced arms 32*a* and 32*b* extending upwardly and leftwardly, and at their ends mounting a pin 34** extending therebetween.

Figure 2:
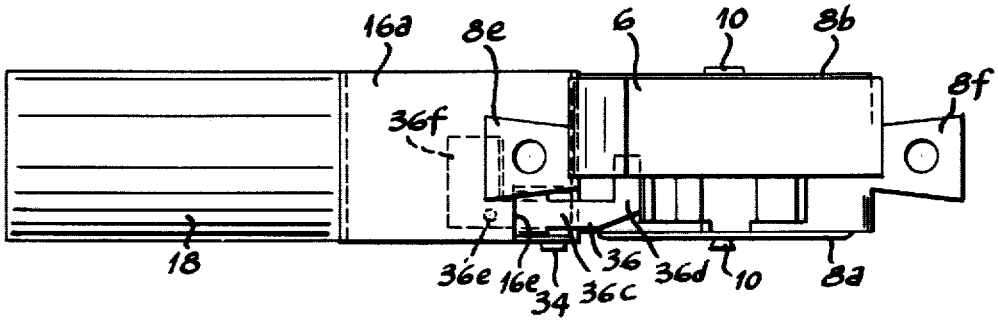
FIG. 2 is a top elevation view of the embodiment shown in FIG. 1.

Mounted to pin 34 for pivotal movement is a lever 36 having central front and rear spaced downwardly extending legs **36*a* and 36*b*, FIGS. 1 and 3, having apertures in their lower ends through which pin 34 extends. Referring to FIG. 1, lever 36 has a right arm 36*c* extending rightwardly and upwardly a short distance through a forwardly opening notch 16*e*, FIG. 2, in top frame side 16*a*, and then extending horizontally rightward to overlie left arm 8*e* of the upper switch housing section. From the right end of right arm 36*c* there is a slightly bowed tip 36*d*, FIG. 1, which extends rearwardly, FIG. 2, to underlie the left half of rocker button 6. Lever 36 has a left arm 36*e* extending leftwardly and downwardly, FIG. 1, and at its end having a rearwardly extending tip 36*f*, FIG. 3, which overlies and engages the top edge of plunger disk 26, FIG. 1**.

Figure 4:
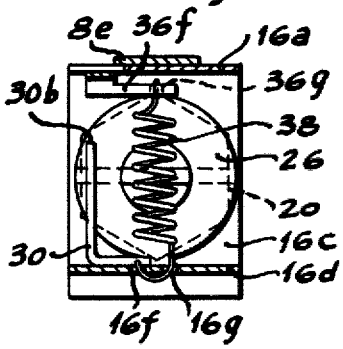
FIG. 4 is a cross-sectional view taken along line 4—4 of FIG. 1.

A helical tension spring 38 is disposed behind tang 30, FIG. 1, and is hooked at its bottom end through a pair of closely spaced apertures **16*f* and 16*g*, FIG. 4, in bottom frame side 16*d*, and is hooked at its top end through an aperture 36*g* in left lever tip 36*f* near the edge thereof, FIG. 3. Spring 38 thus biases left lever arm 36*e* downwardly, and hence lever 36** is biased to pivot counterclockwise.

Operation of the switch and attachment will now be described. FIG. 1 shows rocker button 6 in a clockwise pivoted OFF position. The user depresses the left half of the rocker button to pivot the rocker button counterclockwise about pin 10 to an ON position and close a circuit to turn on a machine or other load, etc. In the ON position, the left underedge **6*a* of the rocker button rests on or just above right lever arm tip 36*d* and left housing arm 8*e***.

A trip signal applied to wires 28 energizes solenoid 18 whereby plunger 24 and disk 26 are retracted leftwardly, compressing spring 25. This releases left lever tip 36*f* whereby lever 36 pivots counterclockwise about pin 34 under the influence of tension spring 38 until left lever tip 36*f* and arm 36*e* are stopped against top edge 30*b* of tang 30. During counterclockwise pivoting of lever 36, right lever tip 36*d* moves upwardly, striking left rocker button underedge 6*a* and driving the rocker button to its clockwise pivoted OFF position.

Depending on the range of motion of lever 36, the strength of spring 38, and the length of the moment-arms from the pivot point of lever 36 with the corresponding mechanical advantage afforded thereby, it may be necessary to add a compression spring 40, FIG. 1, to assist in the kick-off. Spring 40 bears between left housing arm 8*e* and an inner surface 6*b* of the hollowed out rocker button, and is disposed rearwardly of right lever arm 36*c* and tip 36*d*. The rating of spring 40 is chosen weak enough so as not to prevent the rocker button from remaining in its counterclockwise ON position when lever 36 is in its latched clockwise position, FIG. 1. When lever 36 is released, spring 40 will aid spring 38 in kicking the rocker button OFF.

After the rocker button has been kicked OFF and after termination of the trip signal, the latch mechanism of attachment 4 may be reset to a loaded condition by depressing the rocker button back to its counterclockwise ON position. Left rocker button underedge 6*a* engages right lever arm tip 36*d* to depress the latter downwardly, thus pivoting lever 36 clockwise whereby left lever arm tip 36*f* moves upwardly thus allowing plunger disk 26 to move rightwardly to the position shown in FIG. 1 due to spring 25.

It is recognized that various modifications and alternatives are possible within the scope of the appended claims.

What is claimed is:

1. An electric switch comprising in combination:

(a) a switch housing;

(b) contact means in said housing;

(c) manually engageable operator means movably mounted to said housing for effecting actuation of said contact means, said operator means being movable to at least first and second stable positions; and (d) an auxiliary attachment mounted to said housing for moving said operator means from said second position to said second position in response to a trip signal, comprising:

(i) a frame mounted to said housing;

(ii) trip means mounted to said frame and having a trip member movable from a first to a second position responsive to said trip signal, and normally biased to said first position in the absence of said trip signal;

(iii) a lever movably mounted to said frame for movement between tripped and non-tripped positions, said lever having a first arm engageable with said operator means and a second arm engageable with said trip member; and (iv) means biasing said lever to said tripped position;

such that in the absence of said trip signal, said trip member is normally in said first position and engages said second lever arm to maintain said lever in said non-tripped position against the bias of said biasing means, said first lever arm being out of the path of motion of said operator means between said first and second positions of the latter;

and such that in response to said trip signal said trip member moves to said second position and releases said second lever arm such that said lever moves to said tripped position under the influence of said biasing means such that said first lever arm strikes said operator means when in said second stable position to force the latter to said first stable position;

after said trip-signal responsive movement of said operator means from said second to said first stable position, said attachment being resettable by manually moving said operator means to said second stable position wherein said operator means engages said first lever arm and moves said lever to said non-tripped position against the bias of said biasing means and said trip member returns to its normally biased said first position in the path of motion of said second lever arm to retain said lever in said non-tripped position.

2. The invention according to claim 1 wherein:

said operator means is pivotally mounted to said housing and has an external rocker button;

said lever has a central portion pivotally mounted to said frame, said first lever arm extends rightwardly from said central lever portion to overlie said housing and underlie said rocker button;

said biasing means biases said lever counterclockwise to said tripped position;

such that upon release of said second lever arm by said trip member, said lever pivots counterclockwise causing said first lever arm to move upwardly and strike the left underside of said rocker button to force the latter to pivot clockwise to said first stable position.

3. The invention according to claim 2 further comprising second biasing means bearing between said housing and the left underside of said rocker button to bias the latter clockwise, the strength of said second biasing means being great enough to aid said first biasing means in driving said rocker button to said clockwise pivoted first stable position, but being small enough to permit said rocker button to remain in said counterclockwise pivoted second stable position when said lever is in its clockwise pivoted non-tripped position.

4. The invention according to claim 2 wherein:

said second lever arm extends leftwardly from said central lever portion to overlie and engage said trip member when the latter is in said first position and said lever is in its clockwise non-tripped position.

5. The invention according to claim 4 wherein:

said trip means comprises a solenoid and said trip member is a solenoid plunger.

6. The invention according to claim 5 wherein:

said biasing means is a tension spring hooked between said frame and said left lever arm to pull said lever counterclockwise;

said plunger is normally biased rightwardly to an extended said first position and is retracted leftwardly to said second position upon energization of said solenoid in response to said trip signal to thus release said left lever arm;

and comprising a stationary stop member mounted to said frame and providing a stop for the counterclockwise biased pivoting of said lever by engaging said left lever arm at said tripped position and also providing a stop for the rightwardly biased movement of said plunger by engaging said plunger at said extended position.

7. The invention according to claim 6 further comprising second biasing means bearing between said housing and the left underside of said rocker button to bias the latter clockwise, the strength of said second biasing means being great enough to aid said first biasing means in driving said rocker button to said clockwise pivoted first stable position, but being small enough to permit said rocker button to remain in said counterclockwise pivoted second stable position when said lever is in its clockwise pivoted non-tripped position.

8. The invention according to claim 6 wherein:

said frame has top, bottom, left and right sides;

said top frame side has a notch through which said right lever arm extends;

said right frame side has support means mounted thereto which pivotally mounts said central lever portion;

said left frame side has an aperture through which said solenoid is mounted, with said plunger extending interiorly of said frame.

9. The invention according to claim 8 wherein:

said support means is mounted near the upper front edge of said right frame side;

said left lever arm has a rearwardly extending tip;

said stop member is a tang which is mounted to said bottom frame side and extends upwardly from the front thereof, the top edge of said tang stopping the downward movement of said left lever arm, and the left edge of said tang stopping the rightward movement of said plunger;

said tension spring is hooked between said bottom frame side and said left lever arm tip and is disposed behind said tang;

and comprising a compression spring bearing between said housing and the left underside of said rocker button to bias the latter clockwise, the strength of said compression spring being great enough to aid said tension spring in driving said rocker button to said clockwise pivoted first stable position, but being small enough to permit said rocker button to remain in said counterclockwise pivoted second stable position when said lever is in its clockwise pivoted non-tripped position, said compression spring being disposed behind said right lever arm.

* * * * *